US010989492B1

(12) United States Patent
Kempf et al.

(10) Patent No.: US 10,989,492 B1
(45) Date of Patent: Apr. 27, 2021

(54) ARCHERY CAM SHAFT WITH INTEGRATED CABLE TRACK

(71) Applicant: Archery Innovators, LLC, Tiffin, IA (US)

(72) Inventors: James J. Kempf, Coralville, IA (US); Rex E. Isenhower, Stanwood, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 16/867,899

(22) Filed: May 6, 2020

Related U.S. Application Data

(60) Provisional application No. 62/845,931, filed on May 10, 2019.

(51) Int. Cl.
*F41B 5/10* (2006.01)
*F41B 5/12* (2006.01)

(52) U.S. Cl.
CPC ..... *F41B 5/105* (2013.01); *F41B 5/123* (2013.01)

(58) Field of Classification Search
CPC .. F41B 5/105; F41B 5/123; F41B 5/10; Y10S 124/90
USPC ..... 124/25.6, 900
See application file for complete search history.

(56) References Cited

U.S. PATENT DOCUMENTS 4,669,445 A * 6/1987 Schaar ..... F41B 5/10 124/25.6
4,756,296 A * 7/1988 Darlington ..... F41B 5/10 124/25.6
4,838,236 A * 6/1989 Kudlacek ..... F41B 5/10 124/25.6
5,307,787 A * 5/1994 LaBorde ..... F41B 5/105 124/25.6
6,415,780 B1 * 7/2002 Proctor ..... F41B 5/10 124/25.6
6,474,324 B1 * 11/2002 Despart ..... F41B 5/10 124/25.6
6,964,271 B2 * 11/2005 Andrews ..... F41B 5/10 124/25.6
7,441,555 B1 * 10/2008 Larson ..... F41B 5/10 124/25.6
7,938,109 B1 * 5/2011 Larson ..... F41B 5/10 124/25.6
7,971,582 B1 * 7/2011 Larson ..... F41B 5/105 124/25.6
8,069,848 B1 * 12/2011 Larson ..... F41B 5/105 124/25.6
8,408,193 B2 * 4/2013 McPherson ..... F41B 5/105 124/25.6
8,528,534 B2 * 9/2013 McPherson ..... F41B 5/14 124/25.6
8,833,349 B2 * 9/2014 Park ..... F41B 5/10 124/25.6

(Continued)

*Primary Examiner* — Alexander R Nichonovich
(74) *Attorney, Agent, or Firm* — Donald J. Ersler

(57) ABSTRACT

A projectile launching device includes self-timing without cam lean. The projectile launching device may include a frame, energy storing components, such as two limbs, two cam assemblies, a launch string, and at least one cable. The ends of the launch string are attached to the two cams. The cam assemblies are made having a cam body and a pivoting shaft with integrated cable track(s) coupled to each other. The two cam assemblies are built as mirror images of each other, or identical from side to side.

5 Claims, 19 Drawing Sheets

(56) References Cited

U.S. PATENT DOCUMENTS

| | | | | |
|---|---|---|---|---|
| 8,991,376 | B2 * | 3/2015 | McPherson | F41B 5/10<br>124/25.6 |
| 9,115,953 | B1 * | 8/2015 | Huang | F41B 5/1403 |
| 9,528,788 | B2 * | 12/2016 | McPherson | F41B 5/105 |
| 9,816,775 | B2 * | 11/2017 | Miller | F41B 5/10 |
| 9,829,268 | B1 * | 11/2017 | Kempf | F41B 5/123 |
| 10,048,036 | B1 * | 8/2018 | Kempf | F41B 5/123 |
| 10,126,087 | B1 * | 11/2018 | Grace | F41B 5/105 |
| 10,126,088 | B2 * | 11/2018 | Yehle | F41B 5/066 |
| 10,175,023 | B2 * | 1/2019 | Yehle | F41B 5/123 |
| 10,209,026 | B2 * | 2/2019 | Yehle | F41B 5/066 |
| 10,254,073 | B2 * | 4/2019 | Yehle | F41B 5/10 |
| 10,254,075 | B2 * | 4/2019 | Yehle | F41B 5/066 |
| 10,458,742 | B1 * | 10/2019 | Kempf | F41B 5/123 |
| 10,634,447 | B2 * | 4/2020 | Smith | F41B 5/105 |

* cited by examiner

ARCHERY CAM SHAFT WITH INTEGRATED CABLE TRACK

CROSS-REFERENCE TO RELATED APPLICATIONS

This a nonprovisional patent application, which claims the benefit of provisional patent application No. 62/845,931 filed on May 10, 2019.

BACKGROUND OF THE INVENTION

Field of the Invention

The present invention relates generally to archery, and more specifically to the cam and axle configuration on an archery bow, which allows for the axle to be integrated with the cam, and turn in unison with the cam, as the cam rotates.

Discussion of the Prior Art

Generally, an archery cam pivots on an axle, the axle is constrained by limbs, whether by a hole through the limbs, supported on a pillow block, or some form of mounting bracket, wherein the axle is generally stationary. U.S. Pat. No. 7,938,109 to Larson discloses a synchronizing pulley assembly for a compound archery bow, wherein the axle may be integrated with the cam to allow a string track and first cable track rotate with the axle, but the second cable track is designed to pivot independently from the axle, string and first cable track. Though Larson does teach the integration of the axle with the cam, he fails to teach the potential of the present invention. As with all prior art, as the draw string of a shooting bow is pulled, the cam rotates to pay out string from the string groove, as the cable track takes up, or winds, the cable(s) compressing the limbs to store energy. An example would be if a cable track took up 3.5 inches of cable as the bow string was drawn to the ready to fire position, the tips of the limbs would travel 3.5 inches from the resting position to the ready to fire position, and back again. As a general rule, the more the cam rotated, the more the limbs were forced to deflect, or travel. Adverse results of long limb travel include excessive vibration, noise, shock, and fatigue on the limbs.

It has long been a goal to create a cam system for an archery bow that has the least amount of limb travel from the drawn position to the at-rest position. To succeed in this, one must design a cam with a very small perimeter cable track, or a very complex cable track system. One solution for this was the Binary cam system of Darlington, which allowed for payout of the cables to lessen the deflection of the limbs during the draw cycle. An example of this would be if a first cable track took up 3.5 inches of cable and the second cable payed out 1.5 inches of cable as the bow string was drawn to the ready to fire position, the tips of the limbs would travel 2 inches from the resting position to the ready to fire position, and back again. This created many benefits including less vibration and noise, less shock and fatigue on the limbs. One major drawback, however was the increased the complexity in design and manufacture of the new binary cams.

It has also been a goal to make the manufacture of cams easier, due to machining limitations, it often required the use of 4 or 5 axis CNC machines, which are very expensive to own and operate, greatly increasing the cost of components. In order to achieve many of the complex cam designs, manufacturers were left with few options, wherein some cams were machined to consist of as many as 10 separate components to create a cam assembly.

Though all prior art works in to varying degrees, there is still a need for a less complex, easier to manufacture and assemble cam system for an archery bow, be it compound bow or crossbow. The present invention allows for a very small diameter cable track, very little limb travel, and ease of manufacture.

SUMMARY OF THE INVENTION

The present invention of an archery compound bow or crossbow or other arrow launching device, having a first cam body and a second cam body, at least one energy storing component (limb or other), the first and the second cam bodies having a groove along the outer perimeter for receiving a launch string, and a post for anchoring the ends of the launch string. These cam bodies may be identical or mirror images of each other. The present invention having a first pivoting shaft and a second pivoting shaft, these shafts are fashioned with the cable tracks integrated with the shafts, that is the shaft and cable tracks are of one piece. The shaft has a first end portion having a length that is inserted through a bearing, bushing, or other mounting hole to support the first end of the shaft, a first cable track portion for winding and unwinding a first cable segment, a mid section designed for coupling the shaft with the cam, a second cable track portion for winding and unwinding a second cable segment, and a second end portion having a length that is inserted through a bearing, bushing or other mounting hole to support the second end of the shaft. This integration of cam and pivoting shaft may be accomplished by a press fit, mechanical fastener, or other rigid means of fixing the two components with each other, resulting in a cam assembly. These cam assemblies are pivotally journaled with at least one energy storing device.

Unique to the present invention is the ability to have an extremely small diameter cable track, thus resulting in very little limb travel. The present invention may have a shaft diameter small enough to support the requirements of the system, such that a cable track as little as a diameter of 0.185 inches may be achieved. As the cable wraps the shaft of this dimension, this diameter translates to a limb travel of less than 0.600 inches. Varying the size and shape of the cable tracks will change the performance characteristics of the projectile launching device. Further, by having a separate pivoting shaft component, wherein the pivoting shaft component included the pivoting shaft (replacing the prior art axle) and cable tracks, then integrated with a cam body, the cam body would consist of a string track, a string anchor position, and in varying embodiments of the present invention, cable anchors and or cable transitional portals, the cam assemblies may be made modular. The same cam body may be integrated with varying designs of pivoting shaft components. By manufacturing a cam assembly in this fashion, manufacturing costs go down dramatically, and design flexibility substantially increases.

There are many known ways to rig a harness on a compound type bow assembly. These include but are not limited to a single string anchored to opposing cams; wherein a first end of a cable is anchored to a first cam and a second end of the cable is anchored to a second cam, the second end of the cable may be anchored to a limb, a pulley, the same cam, the axle of the second cam, the axle of the first cam; the harness may have a second cable or only one cable. The second cable may attach as the first cable, the present invention may work with all known prior art methods of string/cable harness arrangements for archery bows. Accordingly, it the object of the present invention to provide a cable track of an archery bow cam to be integrated with the pivoting portion of the shaft the pivoting shaft replaces the axle), which is in turn integrated with the cam body, creating a cam assembly wherein the pivoting shaft ends rotate within bearings, bushings or other supporting members (coupled with energy storing components) as the entire cam assembly.

The disclosed invention provides a cam assembly wherein a singular cable groove of the shaft is located above or below the center integrating surface of the shaft, or a cam assembly wherein two mirror image cable grooves of the pivoting shaft are located above and below the center integrating surface of the pivoting shaft.

BRIEF DESCRIPTION OF THE DRAWINGS

FIG. 1B is a view of a pivoting shaft having a smooth cable track the same diameter of the pivoting portion of the pivoting shaft of the present invention.

DESCRIPTION OF THE INVENTION

Figure 1A:
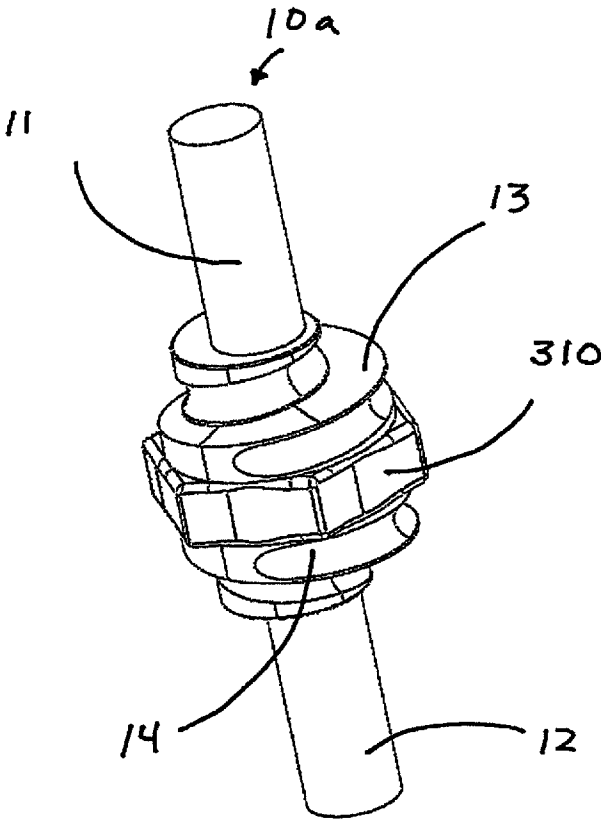
FIG. 1A is a view of a pivoting shaft having spiral cable tracks larger than the diameter of the pivoting portion of the pivoting shaft of the present invention.
Figure 13:
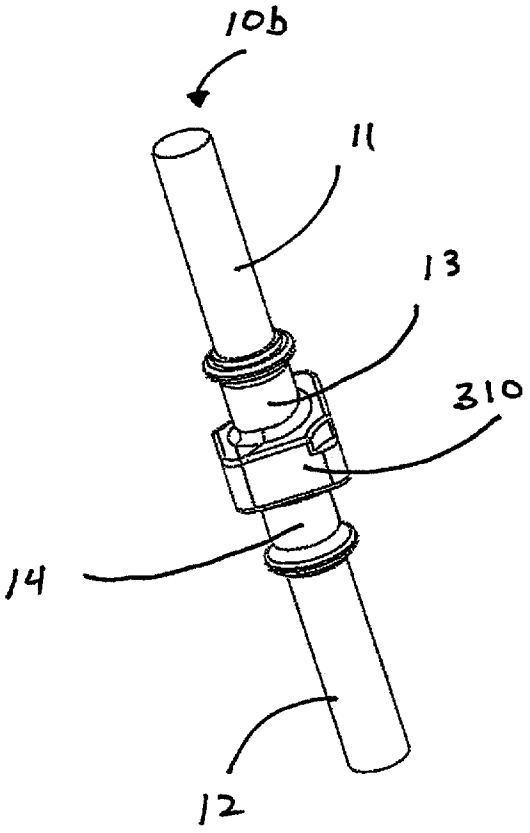
Figure 1C:
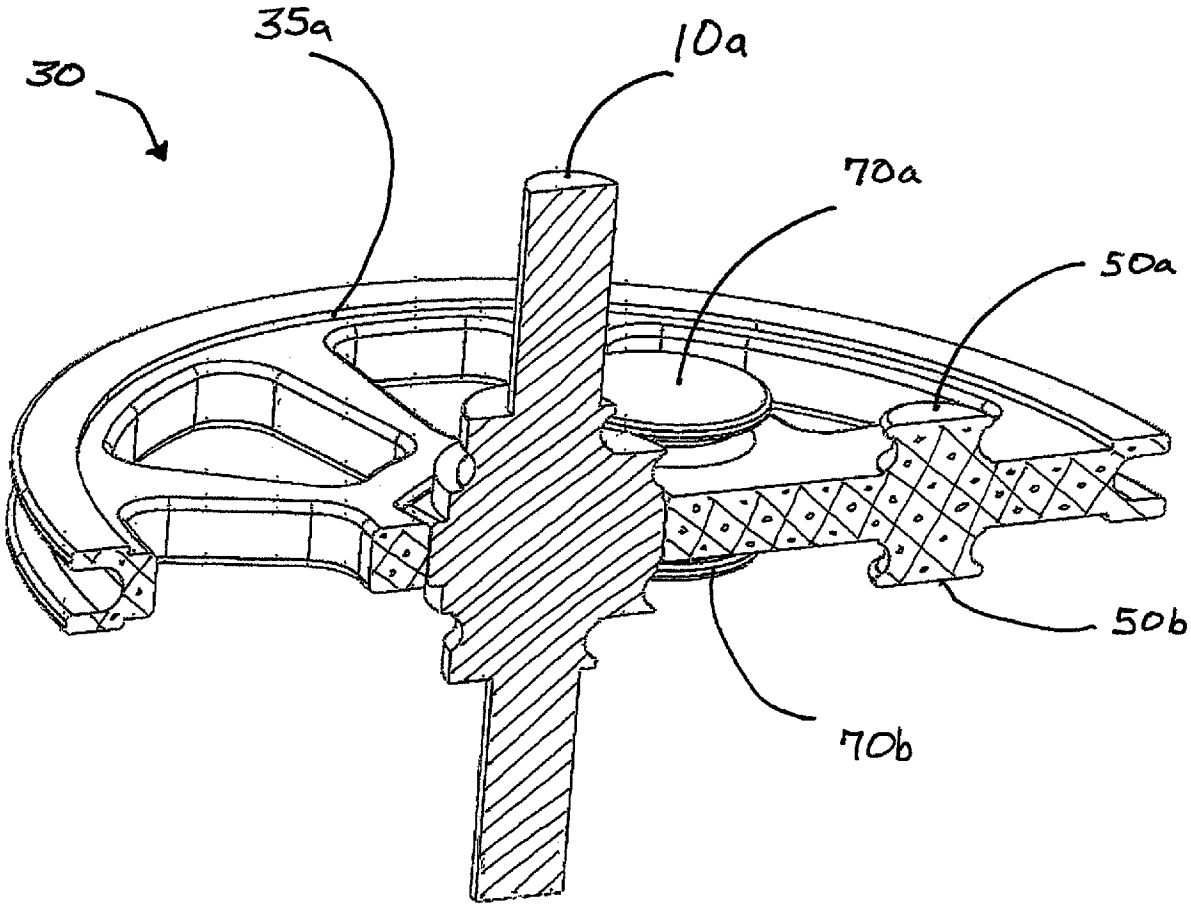
FIG. 1C is a cross sectional view of a pivoting shaft integrated with a cam body of the present invention.
Figure 3A:
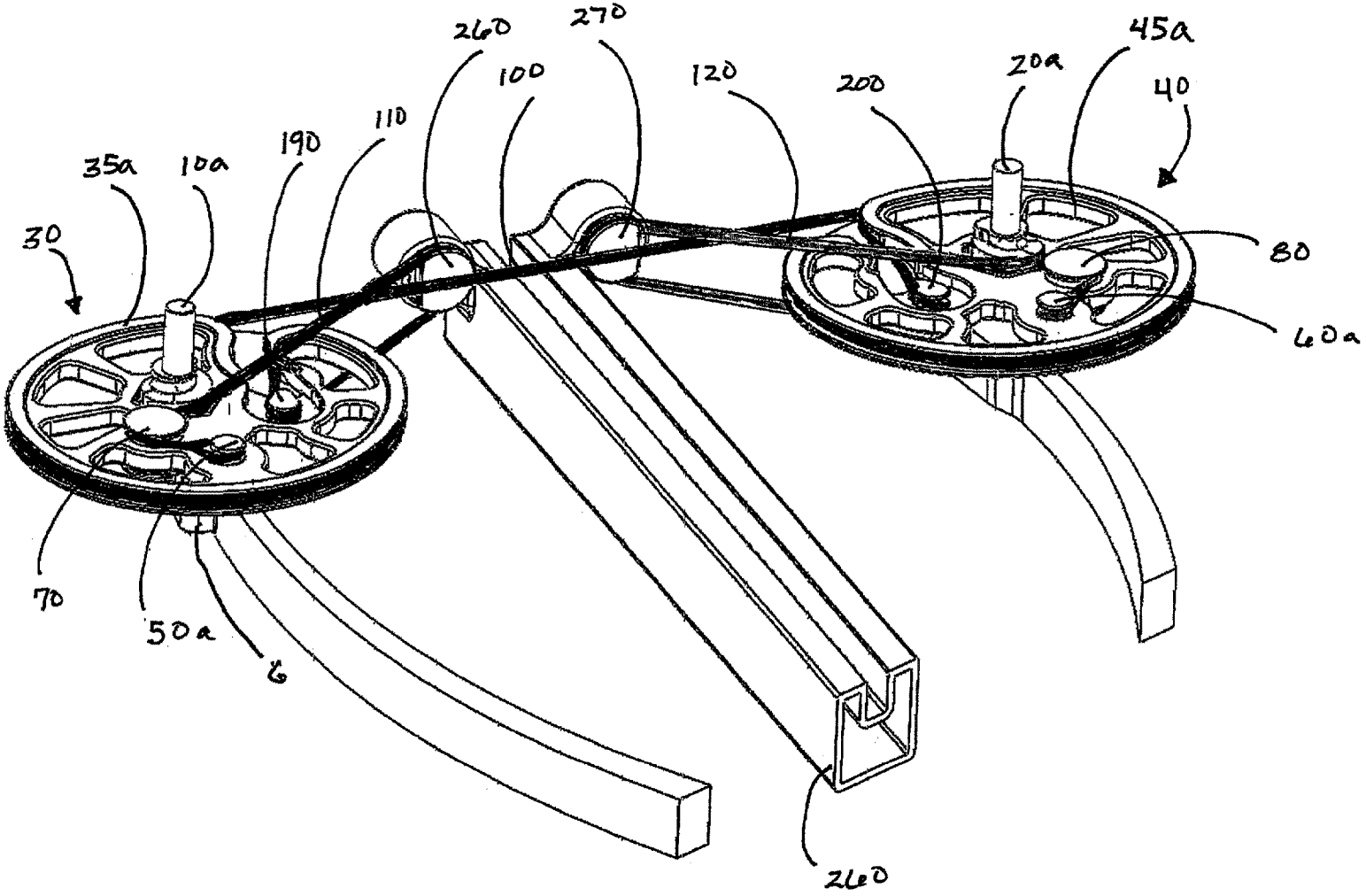
FIG. 3A is a partial view of a reverse style crossbow wherein the cables anchor on the cams of the present invention.

As shown in FIGS. 1, 1A, 1B, and 1C, 2C, and 2D the preferred embodiment of a projectile launching device has a first cam assembly 30 and a second cam assembly 40. More specifically as shown in FIGS. 1A, 1C, and 3A, a first pivoting shaft 10*a* is manufactured having a first end 11, a second end 12, and integrated cable tracks 13 and 14, the cable tracks 13 and 14 are mirror images of each other, and wherein the cables 110 and 120 are partially retained within the cable tracks 13 and 14. A pivoting shaft mating surface 310 is located between the first cable track 13 and the second cable track 14.

Specifically referring to FIG. 1C, a cutaway view illustrates the first cam assembly 30, the first pivoting shaft 10*a* is coupled with the first cam body 35*a*, wherein the first pivoting shaft 10*a* has a first cable track 13 on a first side of the cam body 35*a* and a second cable track 14 is on a second side of the cam body 35*a*. A first cable post 50*a* is provided on a first side of the cam body 35*a*, and a second cable post 50*b* is provided on a second side of the cam body 35*a*. A first cable directional transition post 70*a* is provided on a first side of the cam body 35*a*, and a second cable directional transition post 70*b* is provided on a second side of the cam body 35*a*. In some of the figures the first cam body 35 and the second cam body 45 are illustrated as "35" and "45" for general reference of cam bodies within the first cam assembly 30 and the second cam body 40. The letters "a" and "b" are used to indicate specific embodiments having different cable attachment and or routing configurations of the cam bodies 35 and 45. In a preferred embodiment, the pivoting shaft is press fit into the first cam body 35, wherein the pivoting shaft mating surface 310 is functionally coupled with the cam body mating surface 300, making the first cam assembly 30.

Further, in some of the figures the first axle 10 and the second axle 20 are illustrated as "10" and "20" for general reference. The letters "a" and "b" are used to indicate specific embodiments having different cable tracks, in that "a" has a cable track that is a concave recess sized to receive the cables that extends around the perimeter of the pivoting shaft, the cable tracks may or may not be helical, and the cable does not stack adjacent itself as the cable wraps the cable track. The "b" has a cable track that is generally wider than the cable, wherein the cable does not stack adjacent itself if the cam rotates less than about 320 degrees, or the cable stacks adjacent itself as the cable wraps the cable track when the cam rotates more than about 320 degrees up to 360 degrees and more than 360 degrees.

In a preferred embodiment, the first cam assembly 30 and the second cam assembly 40 are identical, wherein the same assembly may be used on both sides of the projectile launching device which lowers manufacturing costs. In an alternate embodiment, the first cam assembly 30 and the second cam assembly 40 are mirror images of each other.

As shown in FIGS. 2C, 2D, 3A, and 5, the first cam assembly 30 is journaled with the first limb 140 and the second cam assembly 40 is journaled with the second limb 160. The first end of the bowstring 100 is anchored to the first cam string post 190, a first segment of the bowstring 100 at least partially wraps the perimeter string groove 55 of the first cam assembly 30. The bowstring then spans to the second cam assembly 40 and a second segment at least partially wraps the perimeter string groove 58 of the second cam assembly, and the second end of the bowstring 100 is anchored to the second cam string post 200. A first end of the first cable 110 is anchored to the first cam assembly 30 first cable post 50*a*. A segment of the first cable 110 at least partially wraps the first cable directional transition post 70*a*. The cable may or may not engage the first cable track 13 when the bow is in the uncocked or at-rest position as the cable extends to a first cable "pulley" 260. Though the term "pulley" has been used throughout the application, "pulley" references the component used to slide-ably retain and transition the cables from a first side of the bowstring track to the second side of the bowstring track, any component fulfilling the same function may be utilized and may or may not be known as a pulley in the traditional sense, and may or may not function as a rotate-able pulley, as rotation of the component is not a prerequisite to retention and transition of the cables.

A mid-segment of the first cable 110 is retained by the first pulley 260, a segment of the first cable 110 extends to and at least partially wraps a second cable directional transition post 70*b*, and the second end of the first cable 110 is anchored to the first cam second cable post 50*b*. The cable may or may not engage the second cable track 14 when the bow is in the uncocked or at-rest position.

A first end of the second cable 120 is anchored to the second cam assembly 40 first cable post 60*a*. A segment of the second cable 120 at least partially wraps the first cable directional transition post 80*a*. The cable may or may not engage the first cable track 23 when the bow is in the uncocked or at-rest position as the cable extends to a second cable "pulley" 270. A mid-segment of the second cable 120 is retained by the second pulley 270, a segment of the second cable 120 extends to and at least partially wraps a second cable directional transition post 80*b*, and the second end of the second cable 120 is anchored to the second cam second assembly 40 second cable post 60*b*. The cable may or may not engage the second cable track 24 when the bow is in the uncocked or at-rest position. In use, as the bowstring 100 is pulled from the at-rest position to the drawn position, the bowstring 100 unwraps from the perimeter of the first cam assembly 30 and the second cam assembly 40, and simultaneously segments of the first cable 110 and the second cable 120 wrap the cable tracks 13 and 14, and 34 and 24. This embodiment has an archery cam shaft with a first and a second integrated cable track.

Figure 2A:
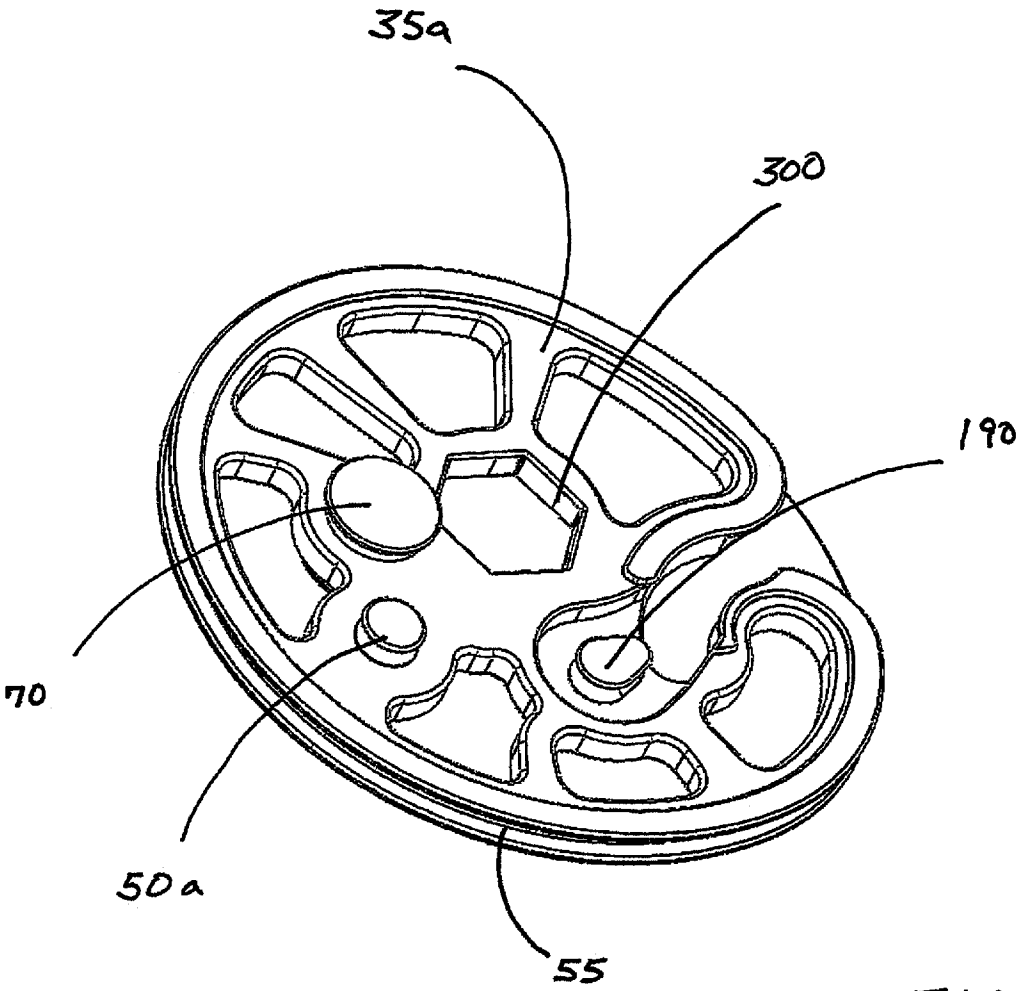
FIG. 2A is a view of a cam body having a perimeter string groove, a cable anchor, a string anchor, and an integration opening of the present invention.
Figure 2B:
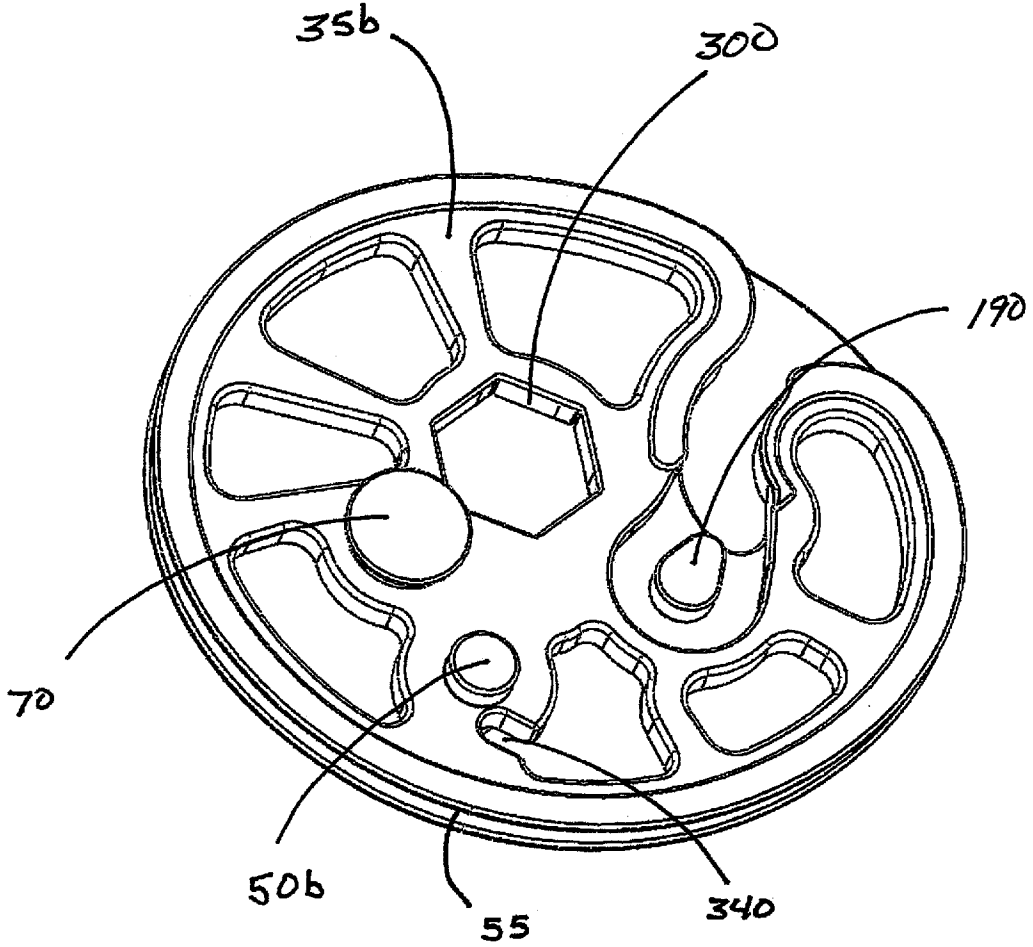
FIG. 2B is a view of a cam body having a perimeter string groove, a cable transition post, a transitional portal, a string anchor, and an integration opening of the present invention.
Figure 2D:
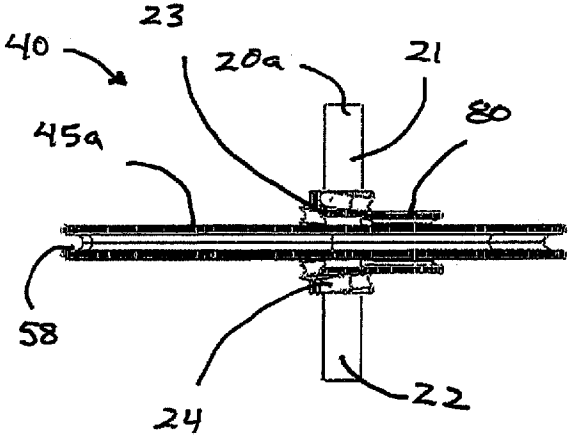
FIG. 2D is a side view of a first pivoting shaft integrated with a first cam body of the present invention.
Figure 2C:
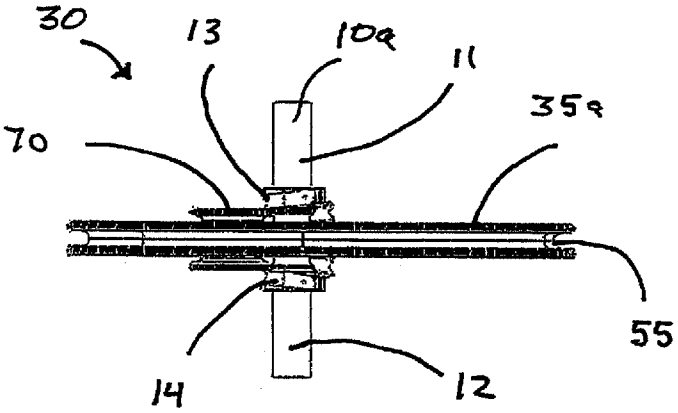
FIG. 2C is a side view of a first pivoting shaft integrated with a first cam body of the present invention.
Figure 3B:
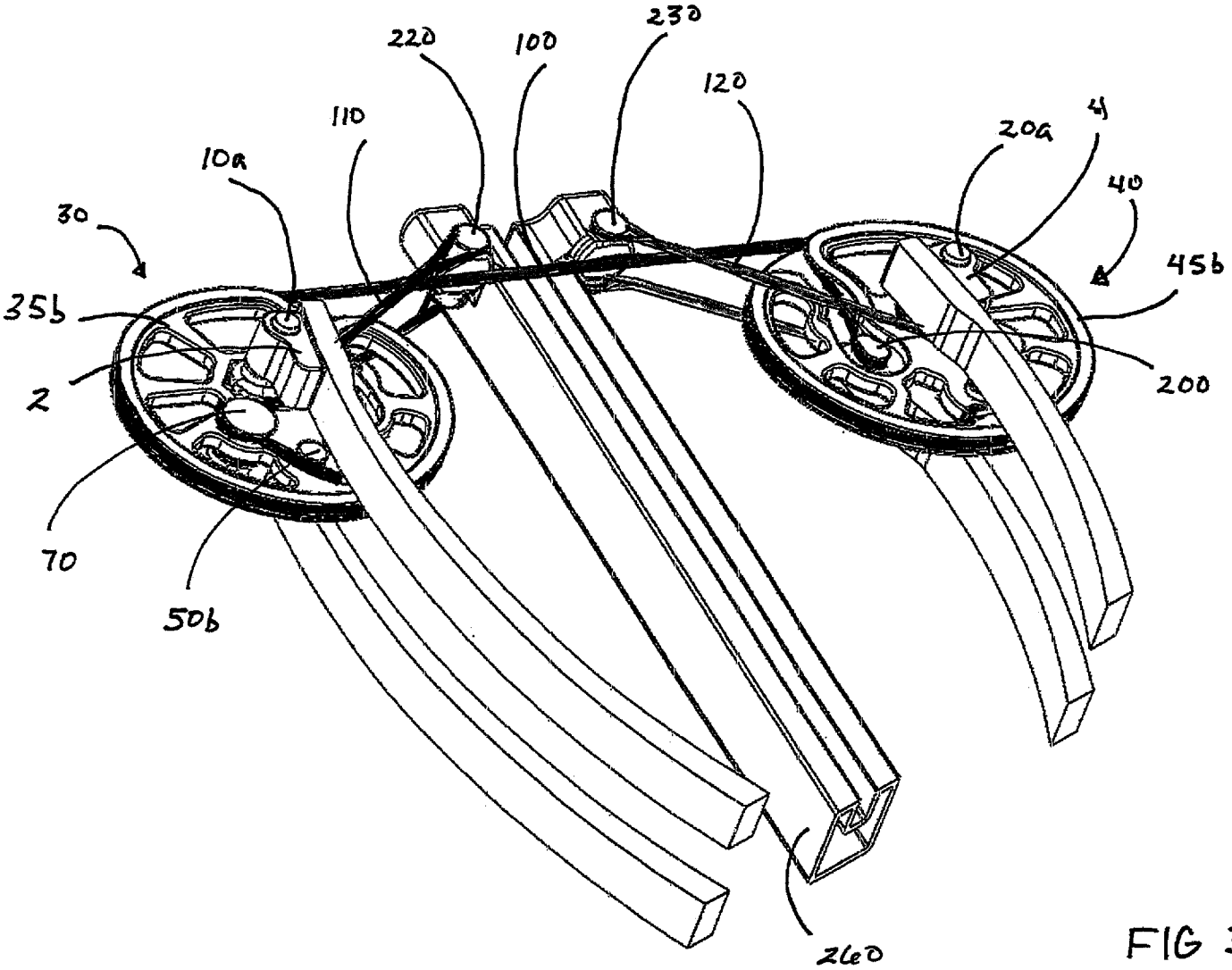
FIG. 3B is a partial view of a reverse style crossbow wherein the cables anchor near the frame of the crossbow of the present invention.
Figure 3C:
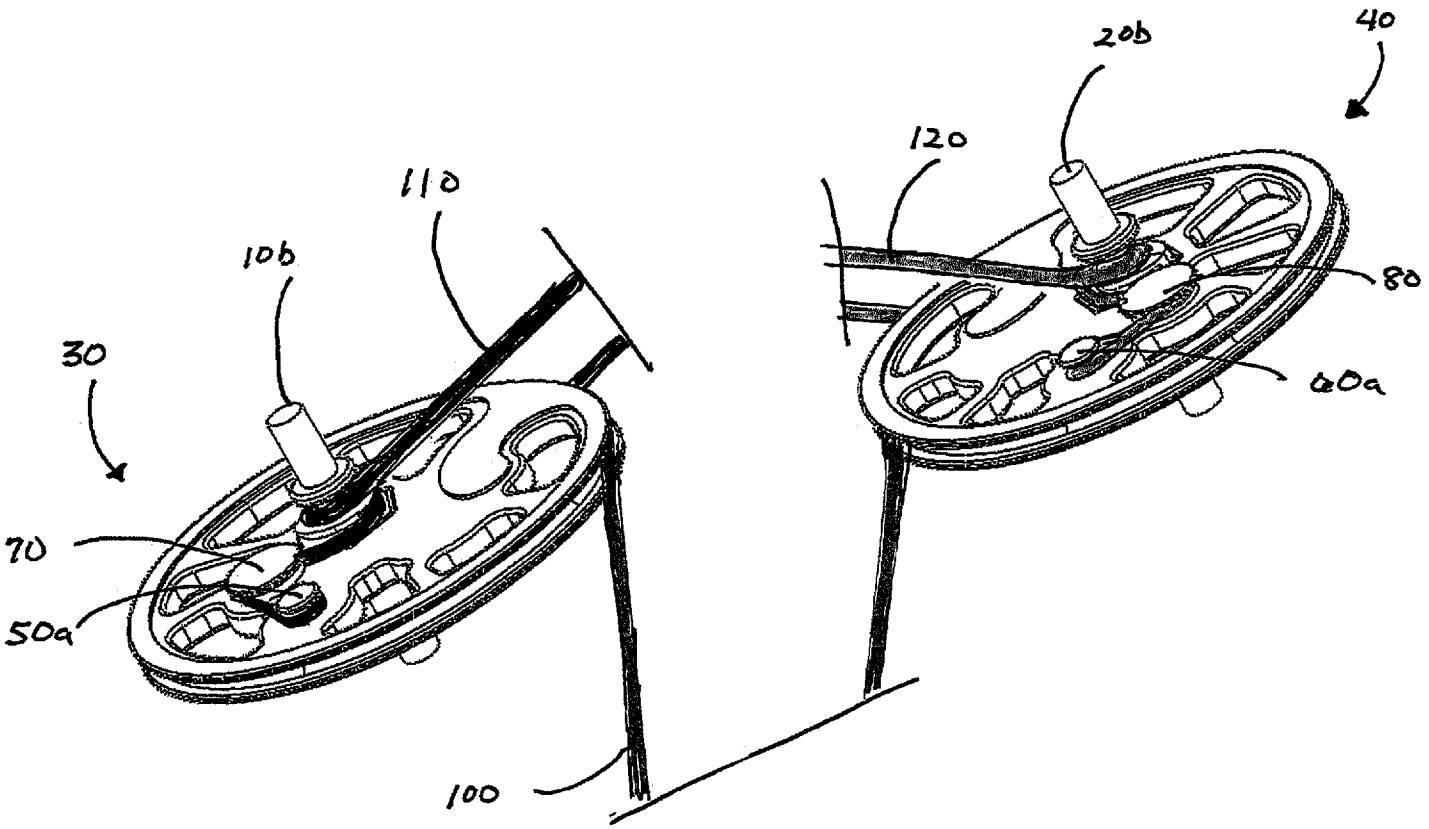
FIG. 3C is a partial cutaway bottom view of the first and second cam assemblies, the pivoting shaft having a smooth cable track the same diameter of the pivoting portion of the pivoting shaft, having one of many string and cable configurations, wherein the bow assembly would be in the drawn or cocked position, of the present invention.
Figure 3D:
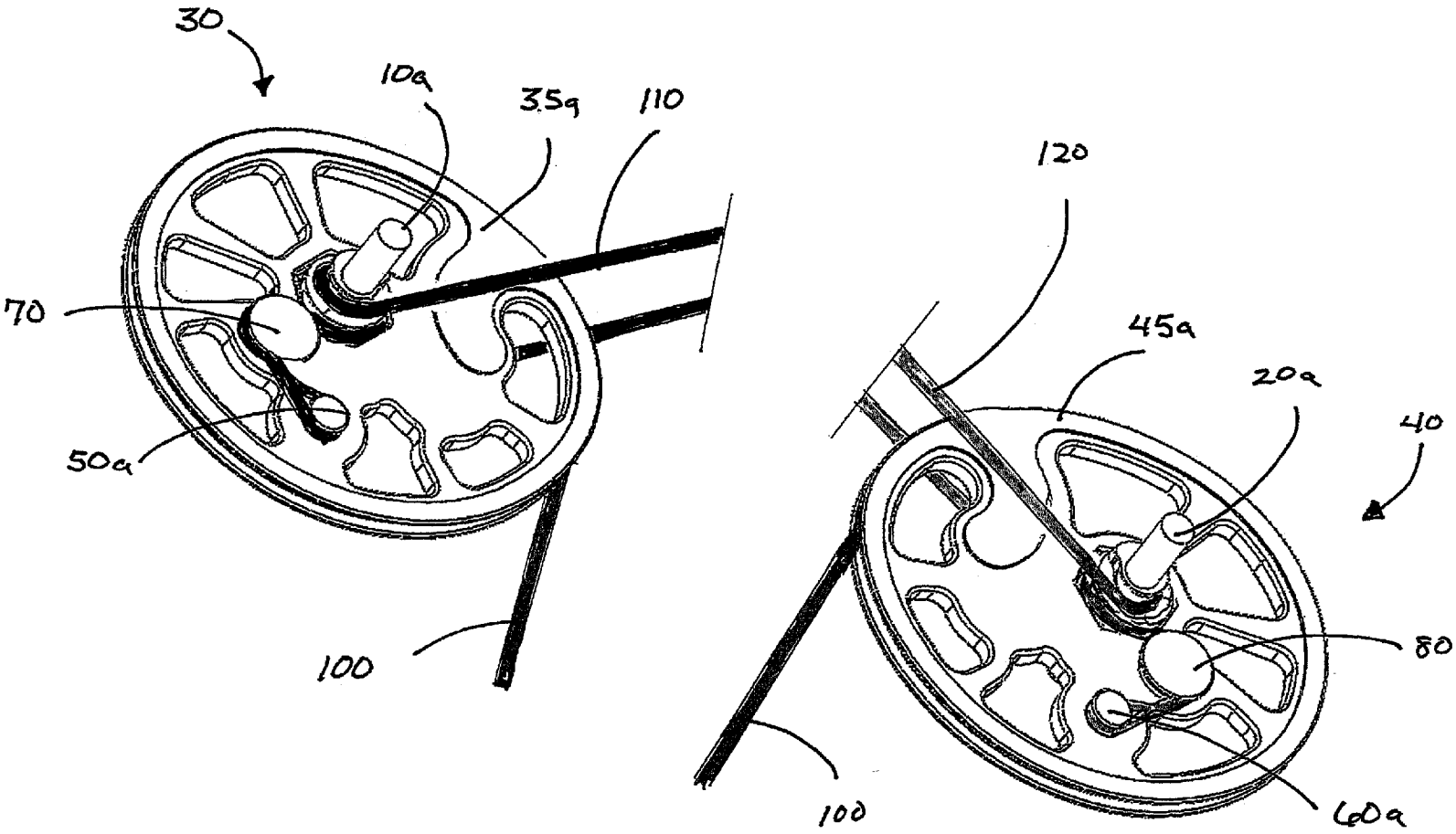
FIG. 3D is a partial cutaway bottom view of the first and second cam assemblies, the pivoting shaft having spiral cable tracks larger than the diameter of the pivoting portion of the pivoting shaft, having one of many string and cable configurations, wherein the bow assembly would be in the drawn or cocked position, of the present invention.
Figure 4:
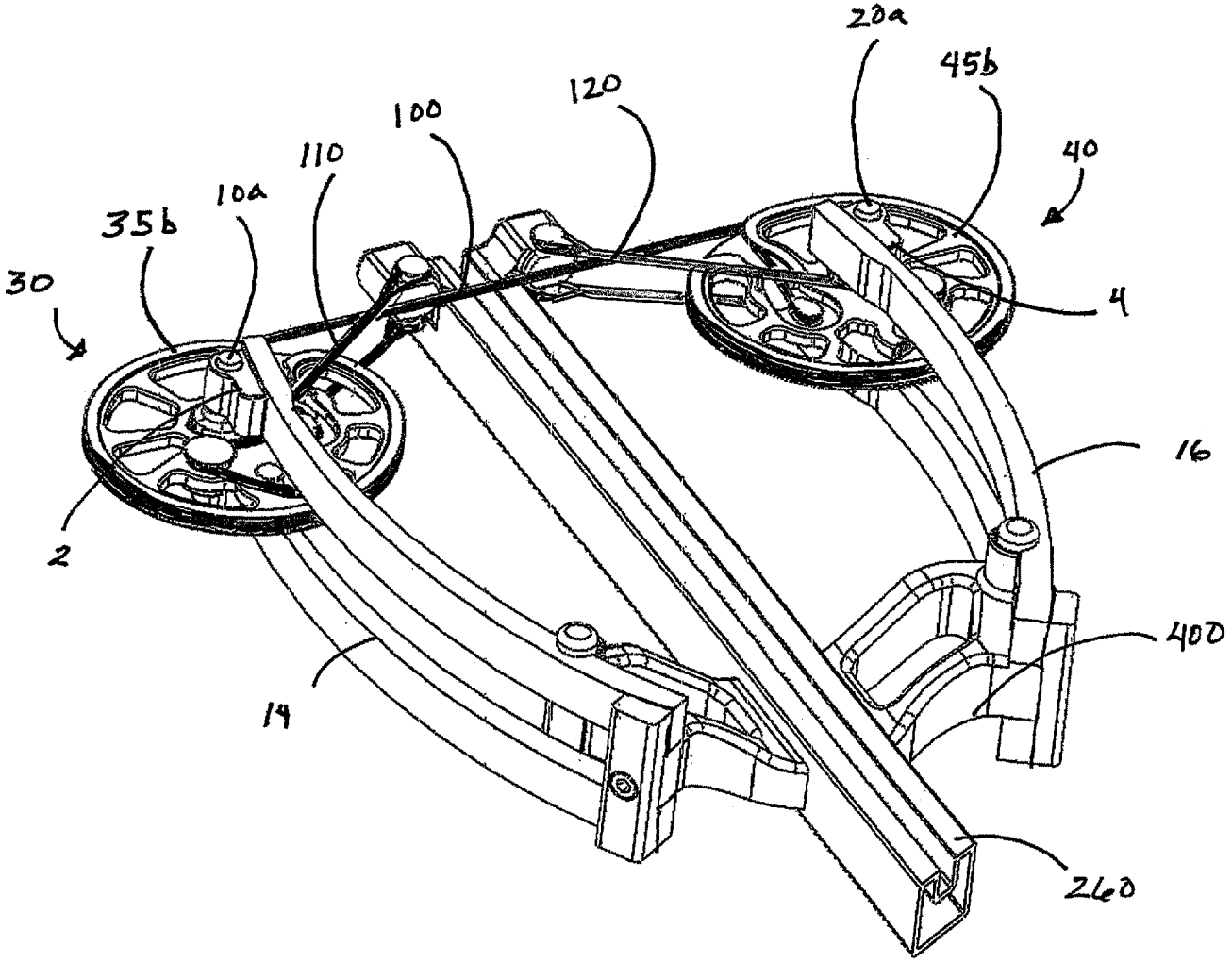
FIG. 4 is a partial view of a crossbow, without stock and trigger mechanism, of the present invention.
Figure 4A:
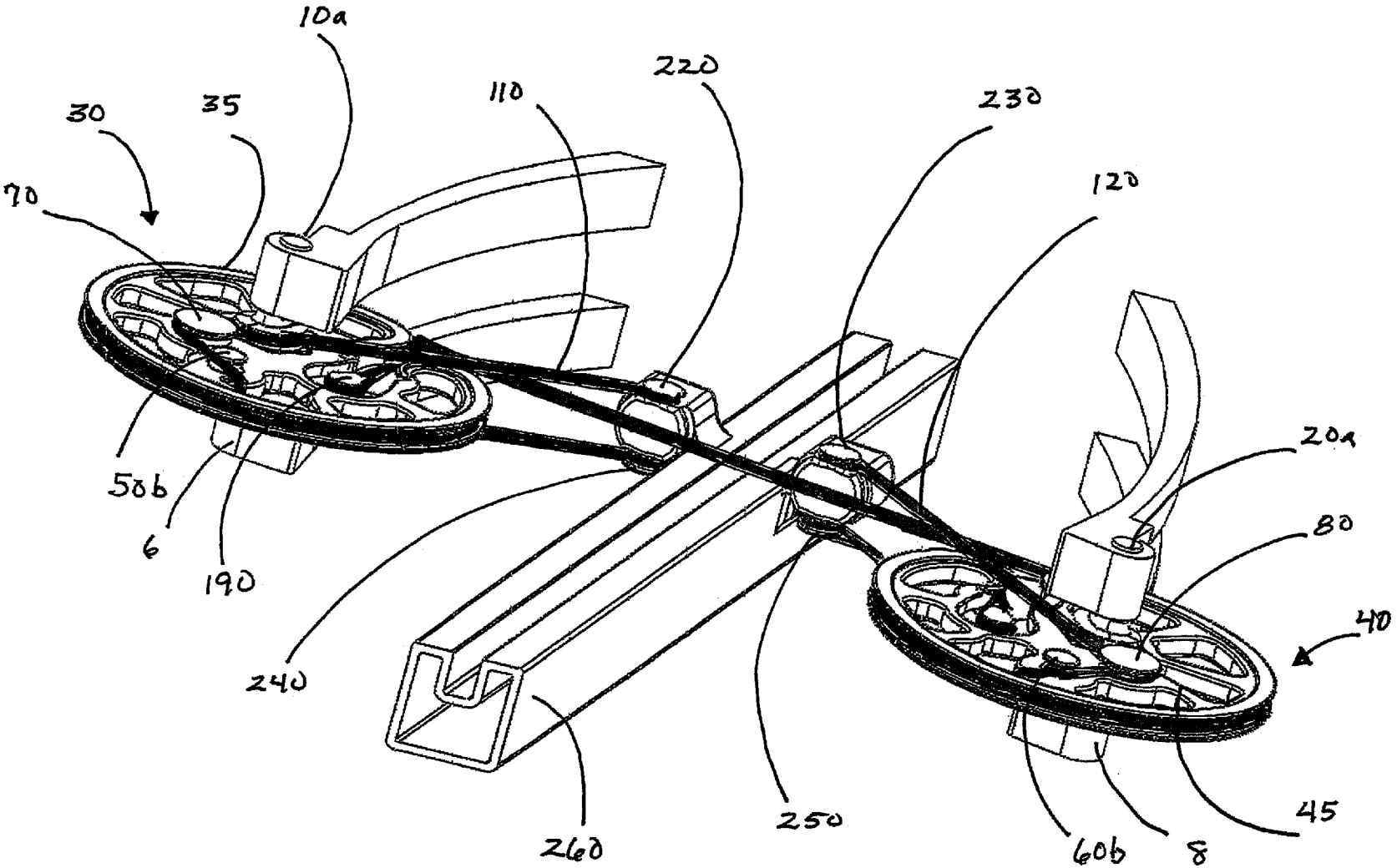
FIG. 4A is a partial view of a conventional style crossbow wherein the cable ends anchor near the frame of the crossbow of the present invention.
Figure 4B:
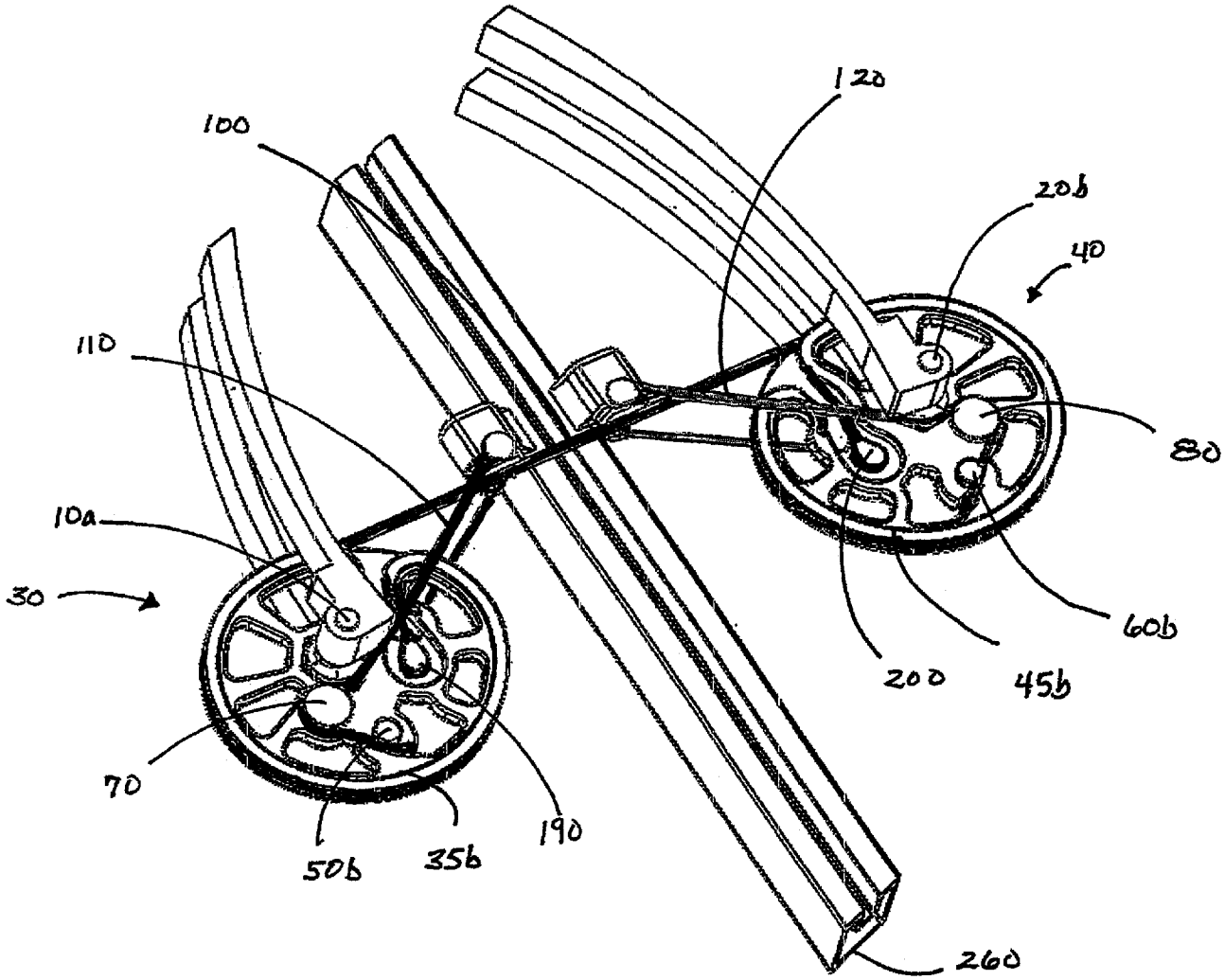
FIG. 4B is a partial view of a conventional style crossbow wherein the ends of the cables anchor near the frame of the crossbow of the present invention.
Figure 5:
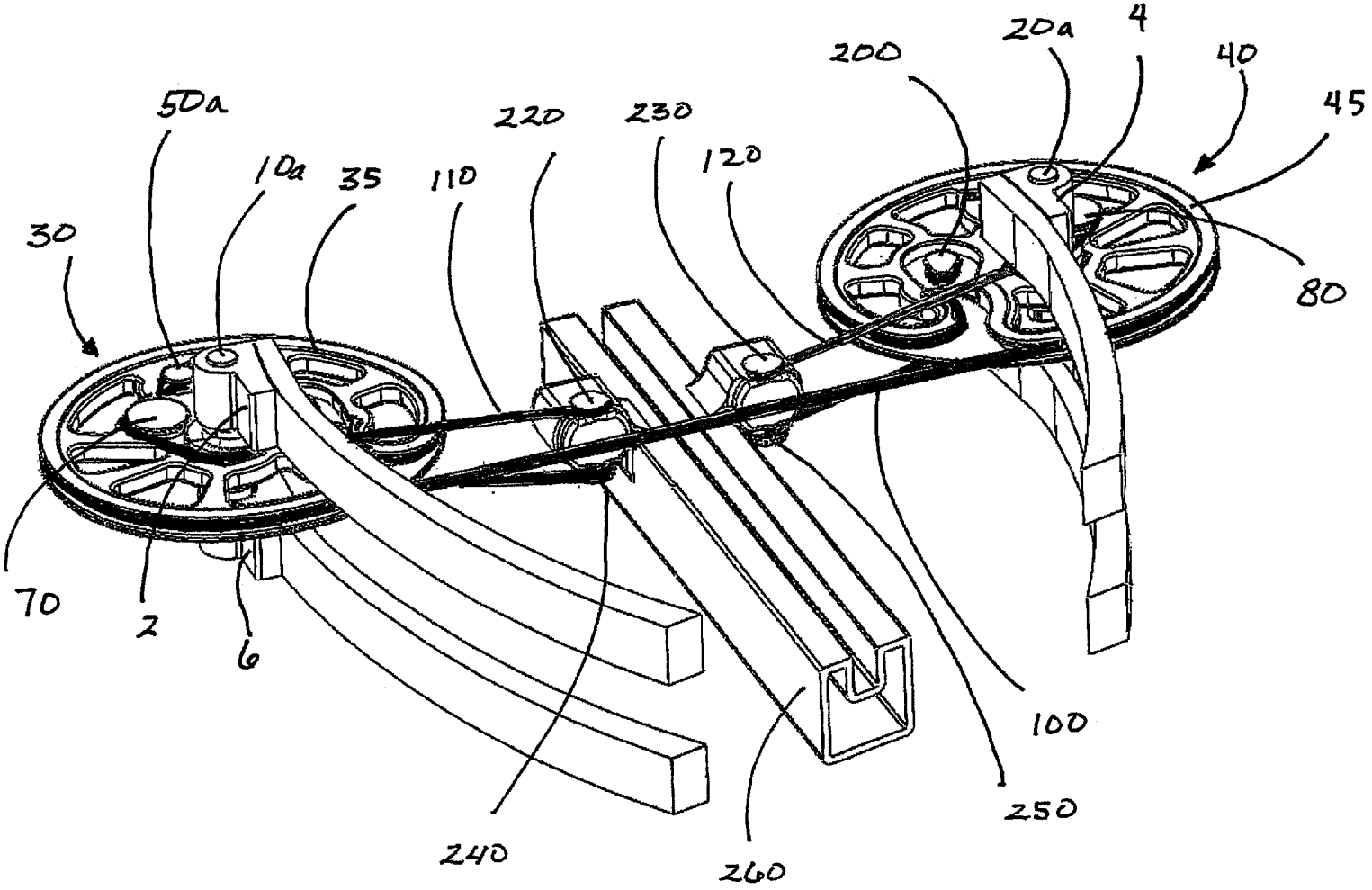
FIG. 5 is a partial view of an alternative reverse style crossbow wherein the cables anchor near the frame of the crossbow of the present invention.
Figure 6:
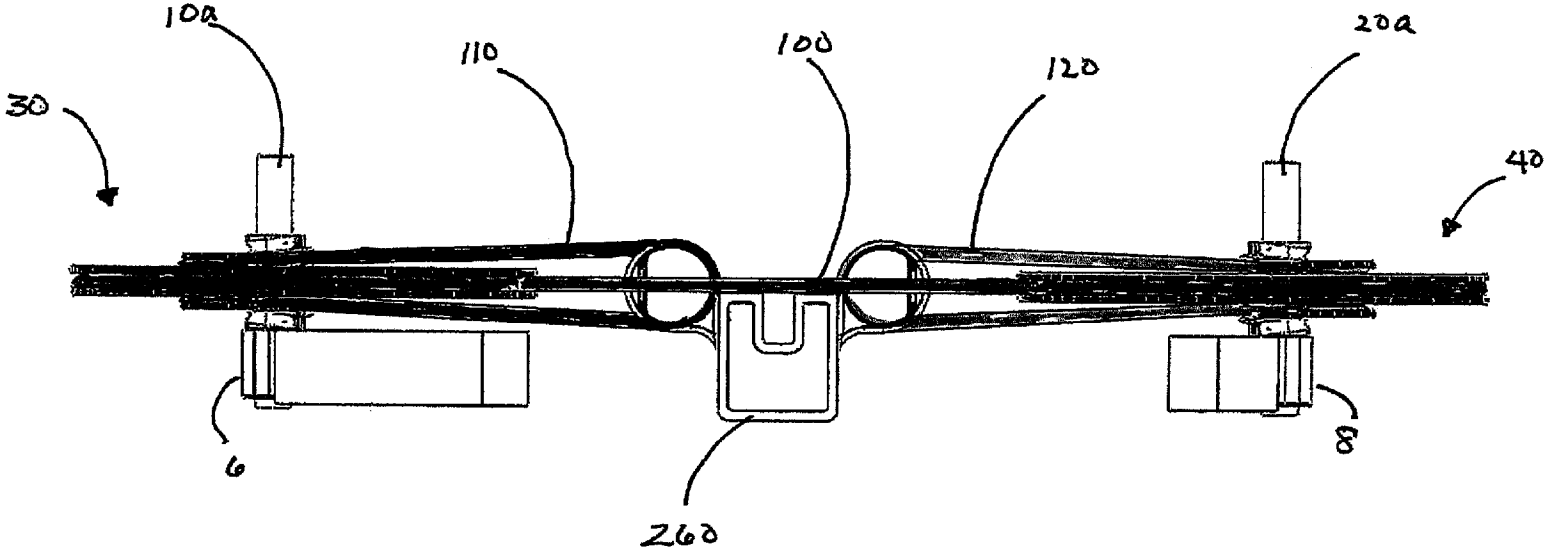
FIG. 6 is a partial rear view showing a possible string cable harness arrangement wherein the cables anchor on the cams of the crossbow of the present invention.
Figure 7A:
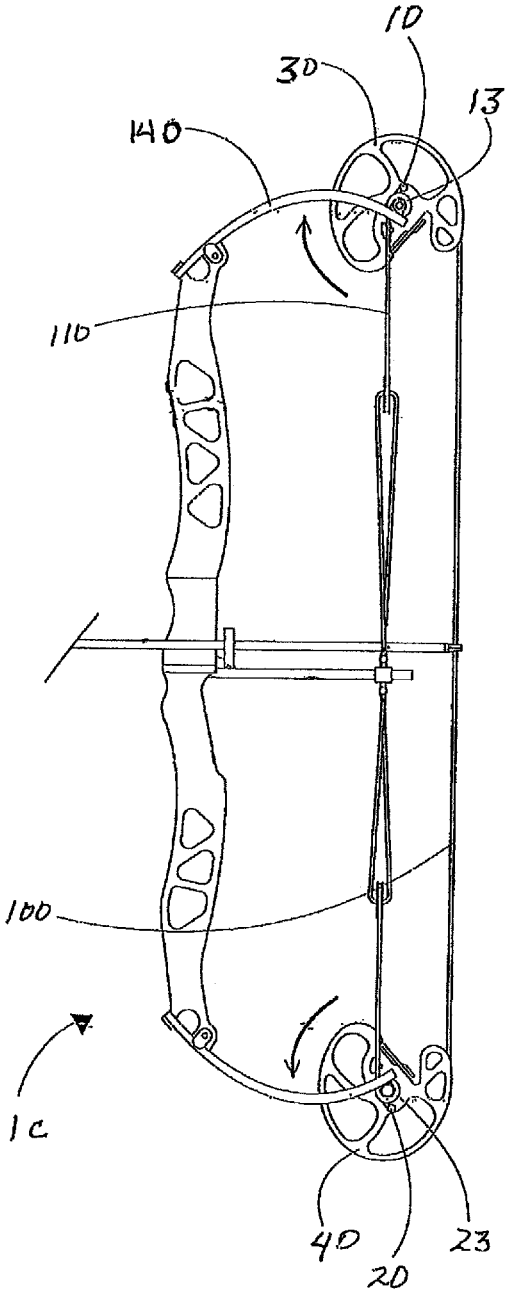
FIG. 7A is a side view of a vertical bow of the present invention.
Figure 7B:
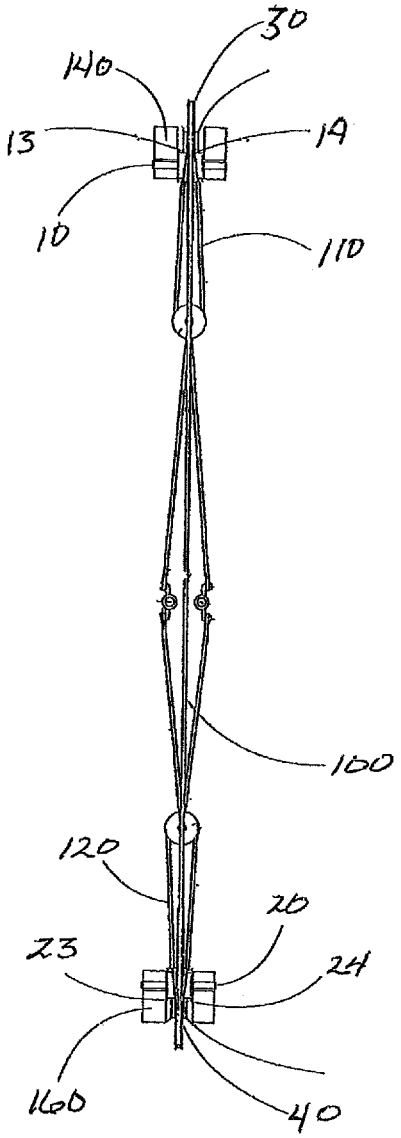
FIG. 7B is a rear view of a vertical bow of the present invention.
Figure 8:
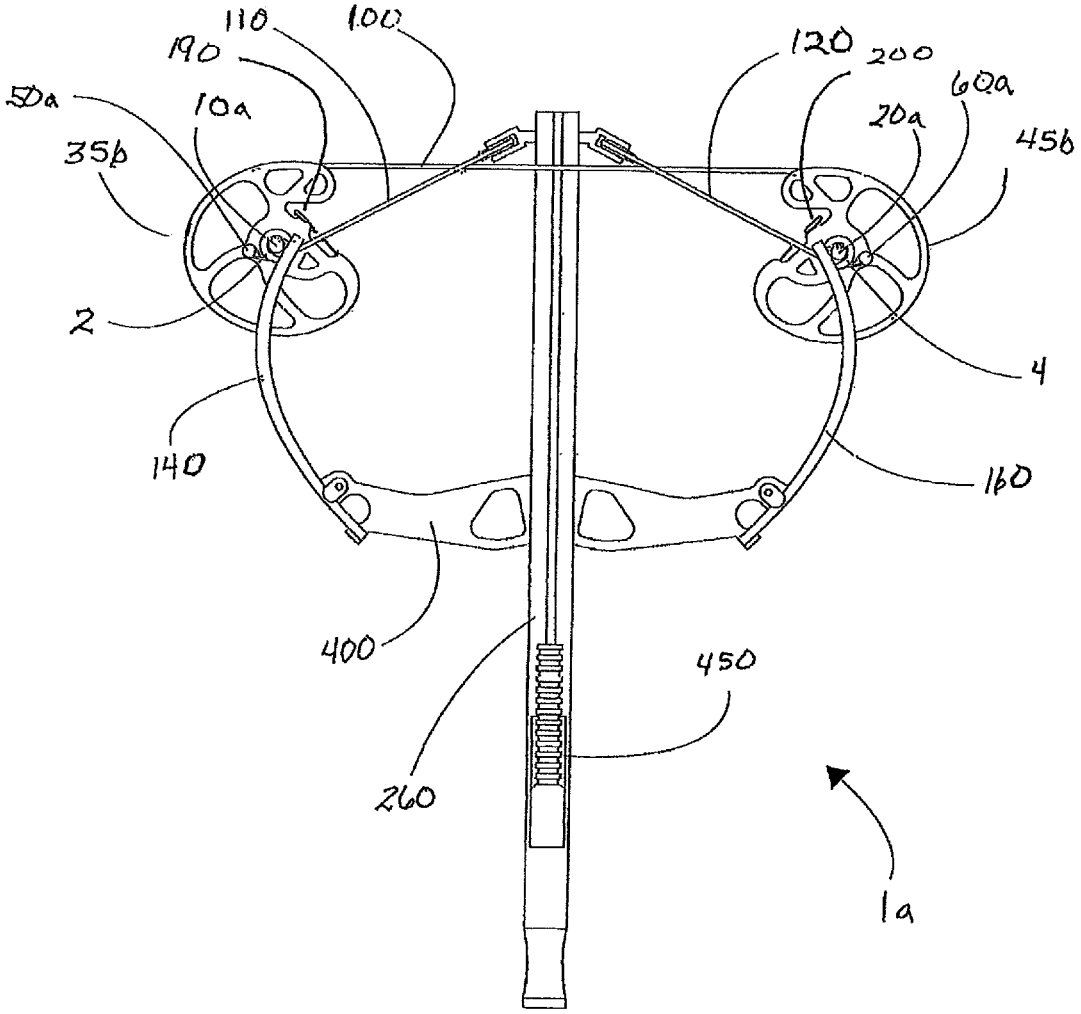
FIG. 8 is a top view of a reverse draw crossbow of the present invention.
Figure 9:
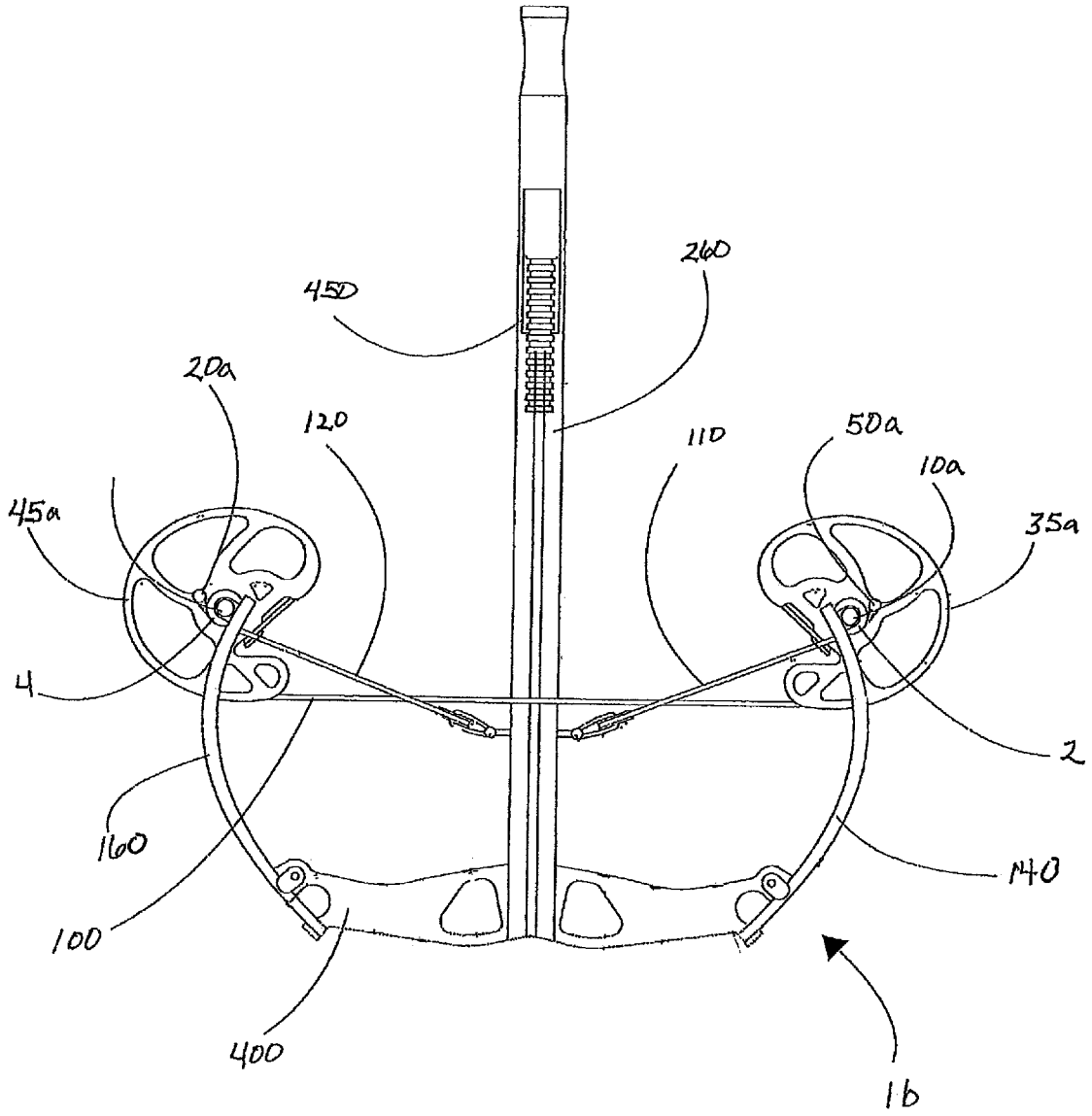
FIG. 9 is a top view of a conventional draw crossbow having inverted cams of the present invention.

Referring specifically to FIGS. 2B, 3B, and 4A a cam assembly is shown wherein the cables do not anchor on the cam body, instead the ends of the cables anchor near the centerline of the projectile launching device, and the mid-segment of the cable passes through the cam and is retained by the cam. A first end of the first cable 110 is anchored to a first cable post 220. A segment of the first cable 110 at least partially wraps the first cable directional transition post 70*a*. The cable may or may not engage the first cable track 13 when the bow is in the uncocked or at-rest position as the cable extends from the first cable post 220. A mid-segment of the first cable 110 is retained by the first transitional portal 340, a segment of the first cable 110 extends to and at least partially wraps a second cable directional transition post 70*b*, and the second end of the first cable 110 is anchored to the second cable post 240. The cable may or may not engage the second cable track 14 when the bow is in the uncocked or at-rest position.

A first end of the second cable 120 is anchored to a third cable post 230. A segment of the second cable 120 at least partially wraps the first cable directional transition post 80*a*. The cable may or may not engage the first cable track 23 when the bow is in the uncocked or at-rest position as the cable extends from the third cable post 230. A mid-segment of the second cable 120 is retained by the second transitional portal 345, a segment of the second cable 120 extends to and at least partially wraps a second cable directional transition post 80*b*, and the second end of the second cable 120 is anchored to the fourth cable post 250. The cable may or may not engage the second cable track 24 when the bow is in the uncocked or at-rest position. This alternate embodiment has an archery cam shaft with a first and a second integrated cable track.

Figure 3E:
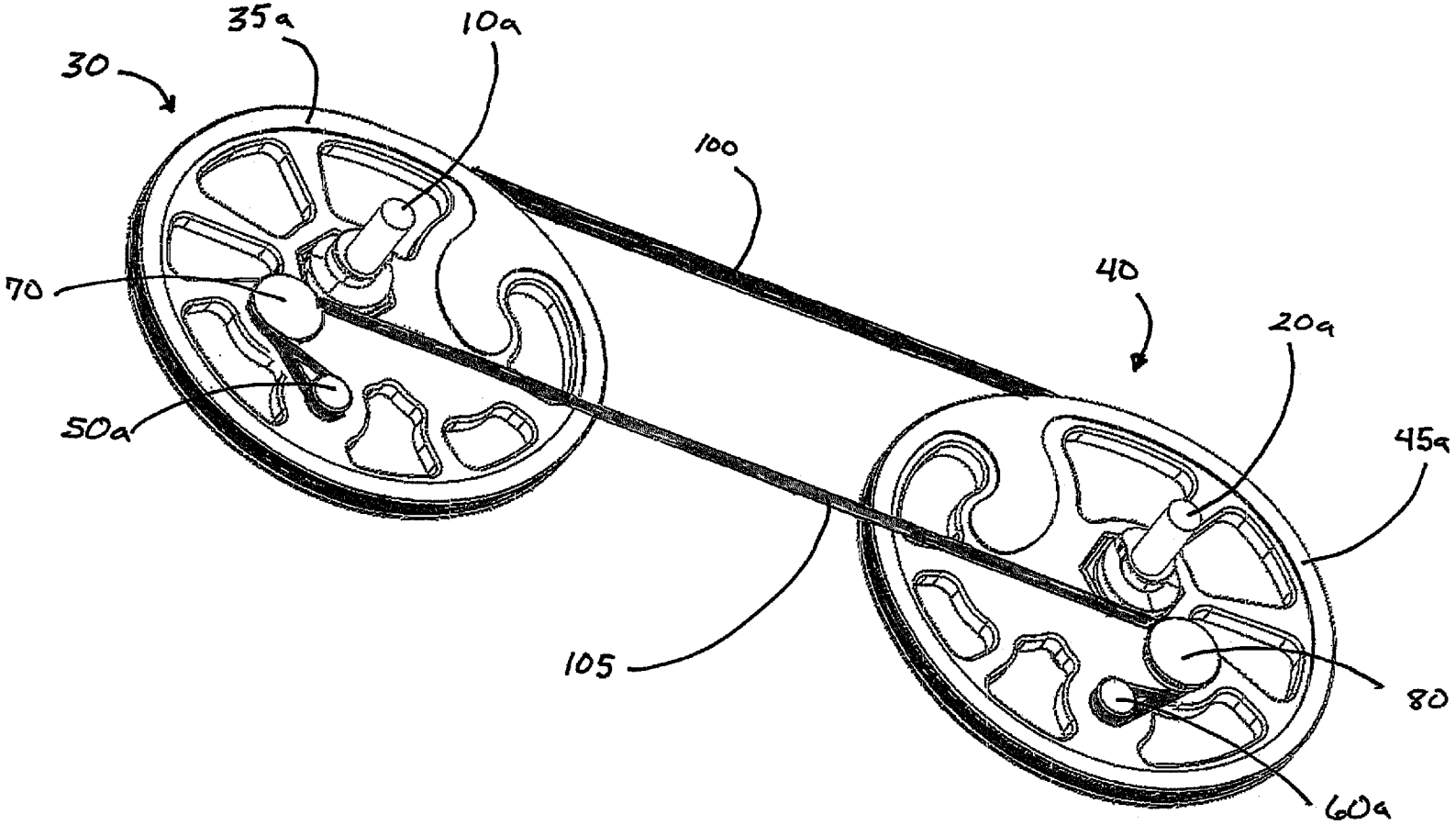
FIG. 3E is a partial bottom view of the first and second cam assemblies, the pivoting shaft having spiral cable tracks larger than the diameter of the pivoting portion of the pivoting shaft, having one of many string and cable configurations, wherein the bow assembly would be in the at rest position, of the present invention.

Now referring specifically to FIG. 3E, an alternate embodiment discloses a first cam assembly 3*o* and a second cam assembly 40 coupled by a bowstring 100, wherein a single cable 105 has a first cable end anchored to the first cam assembly 30 and the second end of the single cable is anchored to the second cam assembly 40. This alternate embodiment has an archery cam shaft with a single integrated cable track.

We claim:

1. A cam assembly for a projectile launching device comprising:

a pivoting shaft includes a cam mating surface, at least one cable track, a first end and a second end, said first end extends from one end of said cam mating surface, said second end extends from an opposing end of said cam mating surface, said at least one cable track is formed as a recessed area in at least one of first and second ends; and a cam includes a string groove, at least one cable post and a pivoting shaft mating surface, said string groove is formed around a perimeter of cam, said at least one cable post is formed on at least one side of said cam, said pivoting shaft mating surface is size to receive said cam mating surface.

2. Two cam assemblies for a projectile launching device comprising:

a bowstring;

at least one first cable and at least one second cable;

a pivoting shaft having a first end, at least one cable track, a cam mating surface, and a second end, said first end extends from one end of said cam mating surface, said second end extends from an opposing end of said cam mating surface, said at least one cable track is formed as a recessed area in at least one of first and second ends; and a cam having a perimeter, a pivoting shaft mating surface, and a bowstring anchor, a string groove is formed in said perimeter to accept said bowstring, and said pivoting shaft mating surface is sized to retain said pivoting shaft, a cam assembly includes said pivoting shaft and said cam body; and a second cam assembly includes a second pivoting shaft and a second cam, said second cam is a mirror image of said cam body, said first and second cam assemblies are pivotally retained on the projectile launching device, opposing ends of the bowstring are retained on said cam body and said second cam, wherein when the bowstring is draw into a ready to fire position, the bowstring unwinds from said first and second cam bodies, simultaneous to a winding of said at least one first cable and said at least one second cable onto said at least one first cable track and said at least one second cable track.

3. The two cam assemblies for a projectile launching device of claim 2 wherein:

said first cam assembly and said second cam assembly having a retainment device for anchoring opposing ends of said at least one first cable and said at least one second cable.

4. Two cam assemblies for a projectile launching device comprising:

a bowstring;

at least one cable having opposing ends engaged with at least two components of the projectile launching device;

a pivoting shaft having a first end, at least one cable track, a cam mating surface, and a second end, said first end extends from one end of said cam mating surface, said second end extends from an opposing end of said cam mating surface, said at least one cable track is formed as a recessed area in at least one of first and second ends;

a cam having a perimeter, a pivoting shaft mating surface, and a bowstring anchor, a string groove is formed in said perimeter to accept said bowstring, said pivoting shaft mating surface is sized to retain said pivoting shaft, a cam assembly includes said pivoting shaft and said cam; and a second cam assembly includes a second pivoting shaft and a second cam, said second cam is a mirror image of said cam, said first and second cam assemblies are pivotally retained on the projectile launching device, opposing ends of the bowstring are retained on said cam and said second cam.

5. The two cam assemblies for a projectile launching device of claim 4 wherein:

said first cam assembly and said second cam assembly having a retainment device for anchoring opposing ends of said at least one cable.

* * * * *